US008585033B2

(12) United States Patent
Ishizu

(10) Patent No.: US 8,585,033 B2
(45) Date of Patent: Nov. 19, 2013

(54) SHEET POST-PROCESSING APPARATUS AND SHEET POST-PROCESSING SYSTEM

(75) Inventor: Ryuichi Ishizu, Osaka (JP)

(73) Assignee: Kyocera Document Solutions Inc., Osaka (JP)

( * ) Notice: Subject to any disclaimer, the term of this patent is extended or adjusted under 35 U.S.C. 154(b) by 0 days.

(21) Appl. No.: 13/427,420

(22) Filed: Mar. 22, 2012

(65) Prior Publication Data

US 2012/0242028 A1 Sep. 27, 2012

(30) Foreign Application Priority Data

Mar. 23, 2011 (JP) ..... 2011-064387

(51) Int. Cl.
*B65H 39/00* (2006.01)

(52) U.S. Cl.
USPC ..... 270/58.17; 270/58.07; 270/58.11; 270/58.12; 270/58.14; 270/58.16; 270/58.18; 270/58.27

(58) Field of Classification Search
USPC ..... 270/58.01, 58.07, 58.11, 58.12, 58.13, 270/58.14, 58.16, 58.17, 58.18, 58.27
See application file for complete search history.

(56) References Cited

U.S. PATENT DOCUMENTS

| | | | | |
|---|---|---|---|---|
| 4,930,761 | A * | 6/1990 | Naito et al. | 270/58.16 |
| 2011/0062647 | A1* | 3/2011 | Tsuchiya | 270/58.09 |
| 2011/0215515 | A1* | 9/2011 | Soga et al. | 270/58.08 |

FOREIGN PATENT DOCUMENTS

| | | | |
|---|---|---|---|
| JP | 64-24064 | U | 2/1989 |
| JP | 2-135368 | A | 5/1990 |
| JP | 7-133050 | A | 5/1995 |
| JP | 2004-277055 | A | 10/2004 |
| JP | 2005-206298 | A | 8/2005 |

* cited by examiner

*Primary Examiner* — Leslie A Nicholson, III

(57) ABSTRACT

A sheet post-processing apparatus includes a guide portion, a command input unit, a post-processing unit, and a guide controller. The guide portion guides a sheet bundle including the sheet carried from a carry-in portion to the processing position. The command input unit that accepts input of a manual execution command. The post-processing unit performs a predetermined post-process on the sheet bundle disposed at the processing position based on the manual execution command input through the command input unit. The guide controller is connected to the image forming apparatus in a signal-receivable manner to receive sheet size information in an image formation period of the image forming apparatus and to control driving of the guide portion to change a guide size based on the received sheet size information so as to match the guide size with sheet bundles having different sheet sizes.

9 Claims, 8 Drawing Sheets

SHEET POST-PROCESSING APPARATUS AND SHEET POST-PROCESSING SYSTEM

This application is based on and claims the benefit of priority from Japanese Patent Application No. 2011-064387, filed on 23 Mar. 2011, the content of which is incorporated herein by reference.

BACKGROUND

The present disclosure relates to a sheet post-processing apparatus and a sheet post-processing system for performing a predetermined post-process on a sheet bundle.

As a sheet post-processing apparatus in the related art, there is a finisher which is attached to an image forming apparatus such as a digital multifunction peripheral to perform a post-process such as a staple process on the sheet bundle.

As a finisher, for example, there is a finisher which performs an automatic post-process associated with an operation of an image forming apparatus and a post-process based on a manual execution command dissociated from the operation of the image forming apparatus.

With respect to the manual post-process, the finisher guides set sheet bundle to a processing position according to a sheet size and performs the post-process based on the manual execution command on the guided sheet bundle.

Accordingly, the finisher is configured to include a guide portion which guides the sheet bundle and matches a guide size of the guide portion with a sheet size of the sheet bundle which is the object of the post-process.

Therefore, during the manual post-process, the finisher allows the manual execution command and the manual setting of the guide size of the guide portion to be performed.

However, the manual setting of the guide size leads to deterioration in workability of the manual post-process and defects of the post-process due to an error in setting.

SUMMARY

According to an aspect of the present disclosure, there is provided a sheet post-processing apparatus including a carry-in portion, a guide portion, a command input unit, a post-processing unit, and a guide controller.

The carry-in portion carries a sheet from an image forming apparatus capable of forming an image on the sheet.

The guide portion guides a sheet bundle including the sheet carried from the carry-in portion to the processing position.

The command input unit accepts input of a manual execution command.

The post-processing unit performs a predetermined post-process on the sheet bundle disposed at the processing position based on the manual execution command input through the command input unit.

The guide controller is connected to the image forming apparatus in a signal-receivable manner to receive sheet size information in an image formation period of the image forming apparatus and to control the driving of the guide portion such that a guide size is changed based on the received sheet size information according to a sheet bundle having a different sheet size.

According to another aspect of the present disclosure, there is provided a sheet post-processing system including an image forming apparatus capable of forming an image on a sheet and a sheet post-processing apparatus.

The sheet post-processing apparatus is configured to include a carry-in portion, a guide portion, a command input unit, a post-processing unit, and a guide controller.

The carry-in portion carries a sheet from the image forming apparatus capable of forming the image on the sheet.

The guide portion guides a sheet bundle including the sheet carried from the carry-in portion to the processing position.

The command input unit accepts input of a manual execution command.

The post-processing unit performs a predetermined post-process on the sheet bundle disposed at the processing position based on the manual execution command input through the command input unit.

The guide controller is connected to the image forming apparatus in a signal-receivable manner to receive sheet size information in an image formation period of the image forming apparatus and to control the driving of the guide portion such that a guide size is changed based on the received sheet size information according to a sheet bundle having a different sheet size.

DETAILED DESCRIPTION

First Embodiment

Sheet Post-Processing System

Figure 1:
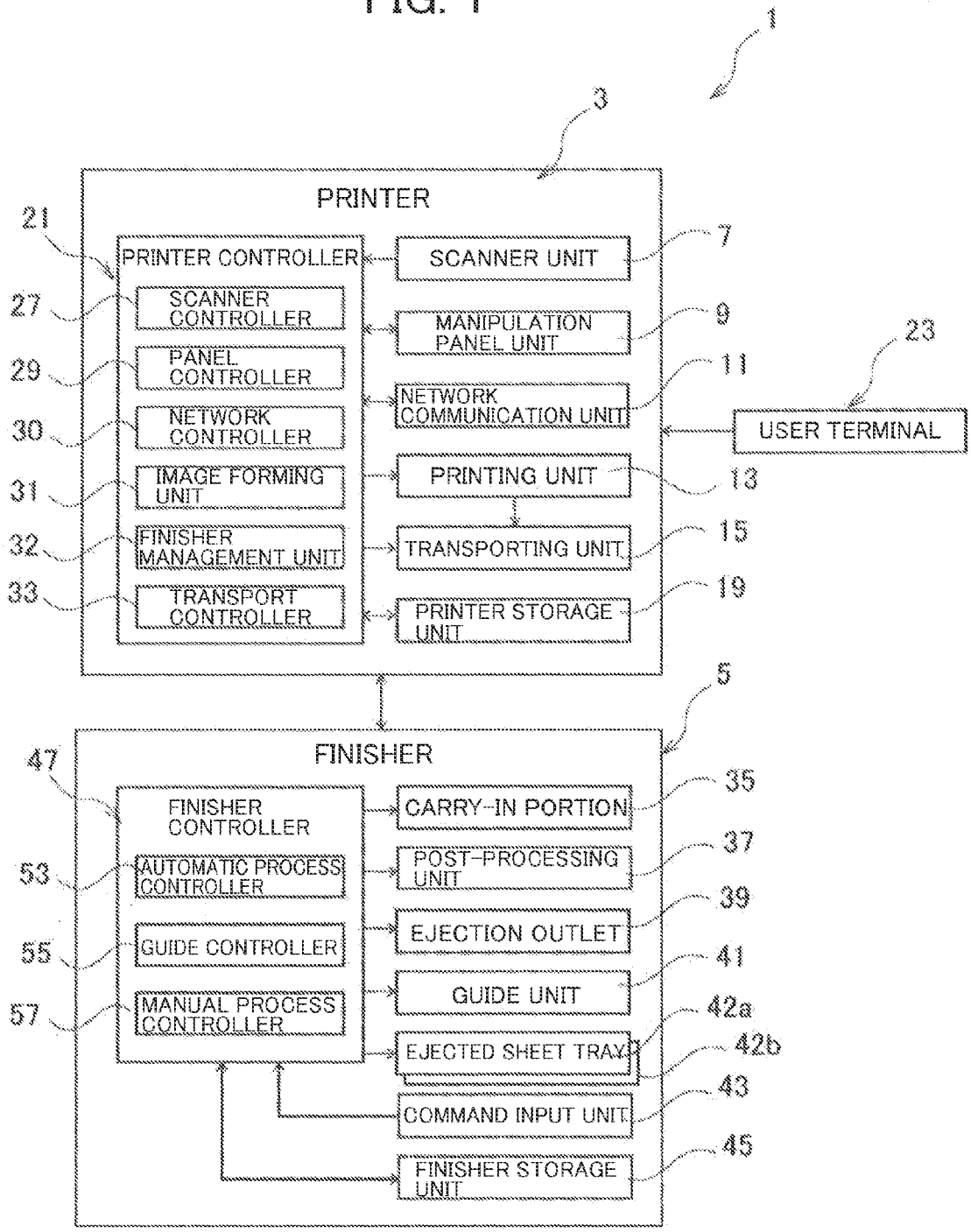
FIG. 1 is a block diagram illustrating a sheet post-processing system (first embodiment)

FIG. 1 is a block diagram illustrating a sheet post-processing system according to a first embodiment of the present disclosure.

As illustrated in FIG. 1, the sheet post-processing system 1 includes a printer 3 as an image forming apparatus and a finisher 5 as a sheet post-processing apparatus.

The sheet post-processing system 1 is configured to perform an automatic post-process (hereinafter, referred to as an "automatic post-process"), which is associated with an operation of the printer 3, and a post-process (hereinafter, referred to as a "manual post-process"), which is based on a manual execution command dissociated from the operation of the printer 3, on the sheet bundle including a sheet printed by the printer 3.

(Image Forming Apparatus)

In the embodiment, the printer 3 is a digital multifunction peripheral having a copier function, a printer function, and the like. The printer 3 performs a print job to print and output an image (image forming) on a sheet.

The printer 3 includes a scanner unit 7, a manipulation panel unit 9 as a manipulation input portion, a network communication unit 11, a printing unit 13, a transporting unit 15, a printer storage unit 19, a printer controller 21, and the like.

The scanner unit 7 reads out an original copy image and outputs image data corresponding to the read-out image to the printer controller 21.

The manipulation panel unit 9 is configured to include a touch panel type liquid crystal display screen and the like. In addition, the manipulation panel unit 9 receives a manipulation input for the printer 3. In addition, the manipulation panel unit 9 performs displaying of manipulation situations, or the like.

The network communication unit 11 transmits and receives data with a user terminal 23 via a communication network such as a LAN.

The printing unit 13 forms an image on a sheet based on the image data obtained by the scanner unit 7 reading out the original copy or the image data transmitted from the user terminal.

The transporting unit 15 transports the sheet where printing is performed (an image is formed) by the printing unit 13 to the finisher 5.

The printer storage unit 19 is configured to include a random access memory (RAM) and a read only memory (ROM) as main memory devices. In addition, the printer storage unit 19 is configured to include a hard disk drive or the like as an auxiliary storage unit. The printer storage unit 19 stores software programs, setting data, and the like necessary for various operations of the printer 3.

The printer controller 21 is configured to include control components such as a central process unit (CPU). The printer controller 21 executes a software program of the printer storage unit 19 to control the printer 3, so that a predetermined unit performs a job. In the embodiment, the printer controller 21 includes a scanner controller 27, a panel controller 29, a network controller 30, an image forming unit 31, a finisher management unit 32, and a transport controller 33.

The scanner controller 27 controls the reading of the scanner unit 7 according to manipulation input to the panel controller 29 described later. Due to the reading control, the scanner unit 7 outputs the image data to the image forming unit 31.

The panel controller 29 controls the receiving of the manipulation input to the manipulation panel unit 9 and the displaying of the manipulation panel unit 9. The panel controller 29 and the manipulation panel unit 9 constitute a manipulation input portion.

In the state where the copying function is performed (in the copying function period), the panel controller 29 receives a print job of the contents designated according to the manipulation input to the manipulation panel unit 9 and transmits print job information to the image forming unit 31. In addition, when the panel controller 29 receives the manipulation input for performing the automatic post-process through the manipulation panel unit 9 at the time of receiving the print job, the panel controller 29 outputs an automatic post-process job to the finisher 5 (finisher controller 47).

In addition, the panel controller 29 receives the later-described manual setting of the guide size according to the manipulation input performed on the manipulation panel unit 9, and outputs information on the setting contents to the finisher 5 (finisher controller 47). The panel controller 29 and the manipulation panel unit 9 are installed separately from a later-described command input unit 43 and constitute a manual setting unit capable of performing the manual setting of the guide size.

The network controller 30 controls transmitting and receiving of data with the user terminal 23 through the network communication unit 11. In the state where a printer function is performed, the network controller 30 receives a print job from the user terminal 23 and transmits the received print job to the image forming unit 31.

The image forming unit 31 executes the print job to generate output image data according to printing conditions. Next, the image forming unit 31 allows the printing unit 13 to perform print outputting on the sheet based on the generated output image data.

The finisher management unit 32 requests the transmission of the guide size information to the finisher 5. In addition, the finisher management unit 32 receives the guide size information from the finisher 5 and stores the guide size information in the printer storage unit 19.

In the case where the automatic post-process is performed, the finisher management unit 32 transmits the setting information of the automatic post-process set by a print job or the like to the finisher 5. In the case where the automatic post-process is not to be performed, the finisher management unit 32 transmits the sheet size information of the print job to the finisher 5.

The finisher management unit 32 compares the guide size information and the sheet size information in the printer storage unit 19. Only in the case where the two sizes are not coincident with each other, the finisher management unit 32 transmits the sheet size of the print job to the finisher 5 (finisher controller 47).

The transport controller 33 controls the transporting unit 15 such that the sheet is transported to the finisher 5.

(Finisher)

The finisher 5 is attached to the printer 3 and connected thereto so as to receive and transmit signals (information) from and to the printer 3. The finisher 5 includes a carry-in portion 35, a post-processing unit 37, an ejection outlet 39, a guide portion 41, ejected sheet trays 42*a* and 42*b*, a command input unit 43, a finisher storage unit 45, and the finisher controller 47.

In the state where an automatic post-process is set (at the time of the automatic post-process), the carry-in portion 35 carries sheets from the printer 3. A plural number of the carried-in sheets are stocked as a sheet bundle.

The post-processing unit 37 performs a predetermined post-process on the sheet bundle. In the state where an automatic post-process is set, the post-processing unit 37 performs a post-process on the stocked sheet bundle. In addition, in the state where a manual post-process is set (at the time of the manual post-process), the post-processing unit 37 performs a predetermined post-process on the sheet bundle set at the processing position. In the embodiment, a staple process is performed as a post-process. However, a punching process, a folding process, or the like may be performed as a post-process.

In the state where the automatic post-process is set, the ejection outlet 39 ejects the post-process-completed sheet bundle. In the state where the manual post-process is set, the ejection outlet 39 functions as a set unit for setting the sheet bundle.

Figure 2:
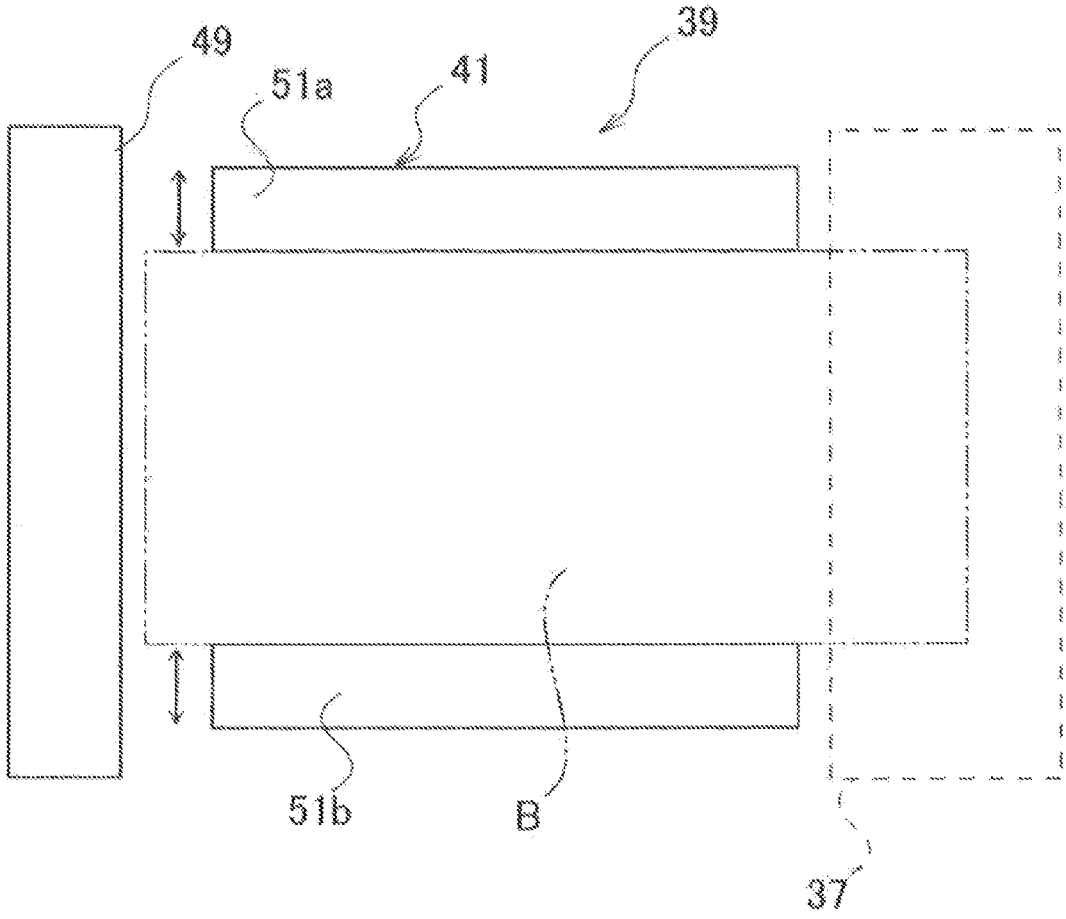
FIG. 2 is a schematic plan view illustrating a configuration of an ejection outlet of a finisher (first embodiment)

FIG. 2 is a schematic plan view illustrating a configuration of the ejection outlet of the finisher.

The ejection outlet 39 is opened and closed by an openable door 49. The guide portion 41 is disposed to the ejection outlet 39.

The guide portion 41 guides the sheet bundle B set to the ejection outlet 39 to a processing position of the post-processing unit 37. The guide portion 41 includes a pair of guide bars 51*a* and 51*b*. The guide portion 41 guides the sheet bundle B using the guide bar 51*a* and the guide bar 51*b*. The guide portion 41 guides the sheet bundle B in the state where the sheet bundle B is interposed between the guide bar 51*a* and the guide bar 51*b*. In addition, the guide portion 41 is configured such that the guide size is changeable.

The guide bars 51*a* and 51*b* are configured to be movable so as to be close or distant with respect to each other. The guide bars 51*a* and 51*b* are configured to be movable in a reciprocating manner in the directions of the arrows illustrated in FIG. 2. The guide bars 51*a* and 51*b* are configured such that the guide size is changeable. More specifically, the guide bars 51*a* and 51*b* move to change their positions so as to change the guide size. The guide bars 51*a* and 51*b* are configured to change the distance therebetween so as to match the guide size with a sheet bundle B having a different sheet size.

The ejected sheet tray 42*a* illustrated in FIG. 1 is a finisher tray for ejecting and holding the automatic-post-process-completed sheet bundle. In addition, the ejected sheet tray 42*b* is a finisher tray for ejecting and holding the printing-completed sheet.

The command input unit 43 is configured to include a switch or the like disposed on, for example, an outer surface or the like of the finisher 5. The command input unit 43 accepts input of a manual execution command. The command input unit 43 is configured so that an open command for the openable door 49 of the ejection outlet 39 and the manual execution command for the sheet bundle B guided to the processing position can be input.

Similarly to the printer storage unit 19 of the printer 3, the finisher storage unit 45 is configured to include a RAM and a ROM. In addition, the finisher storage unit 45 is configured to include a hard disk drive or the like. The finisher storage unit 45 stores software programs, setting data, and the like necessary for various operations of the finisher 5.

Similarly to the printer controller 21 of the printer 3, the finisher controller 47 is configured to include control components such as a CPU. The finisher controller 47 executes a software program of the finisher storage unit 45 to control the finisher 5 to allow a predetermined unit to perform a job. In the embodiment, the finisher controller 47 includes an automatic post-process controller 53, a guide controller 55, and a manual process controller 57.

The automatic post-process controller 53 controls the driving of the carry-in portion 35 and the post-processing unit 37 according to the setting included in the print job or the like in the state where the automatic post-process is set. More specifically, the automatic post-process controller 53 allows the carry-in portion 35 to carry the sheets and to stock the sheet bundle and allows the post-processing unit 37 to perform a post-process on the sheet bundle.

When the sheet size information is received from the printer 3 (finisher management unit 32), the guide controller 55 controls the driving of the guide portion 41 such that the guide size is changed to be a guide size corresponding to the sheet size information. In addition, when the manually-set guide size information is received, the guide controller 55 controls the driving of the guide portion 41 so as to change the guide size to a guide size corresponding to the received guide size information.

The guide size information of the guide portion 41 is stored in the finisher storage unit 45 by the guide controller 55 and transmitted to the finisher management unit 32 according to a transmission request from the finisher management unit 32 of the printer 3.

The manual process controller 57 receives the manual execution command inputted from the command input unit 43 and controls driving of an opening/closing driver (not shown) for opening and closing the openable door 49 of the ejection outlet 39 and driving of the post-processing unit 37. More specifically, when an initial manipulation is received through the command input unit 43, the manual process controller 57 controls the opening/closing driver so as to open the openable door 49. When the next manipulation is received, the manual process controller 57 controls the post-processing unit 37 so as to perform a post-process on the sheet bundle.

Operations of Sheet Post-Processing System

As described above, the sheet post-processing system 1 according to the embodiment is configured to be capable of performing the manual post-process according to the disclosure, which is dissociated from the operations of the printer 3, as well as the automatic post-process associated with the operations of the printer 3.

(Automatic Post-Process)

Figure 3:
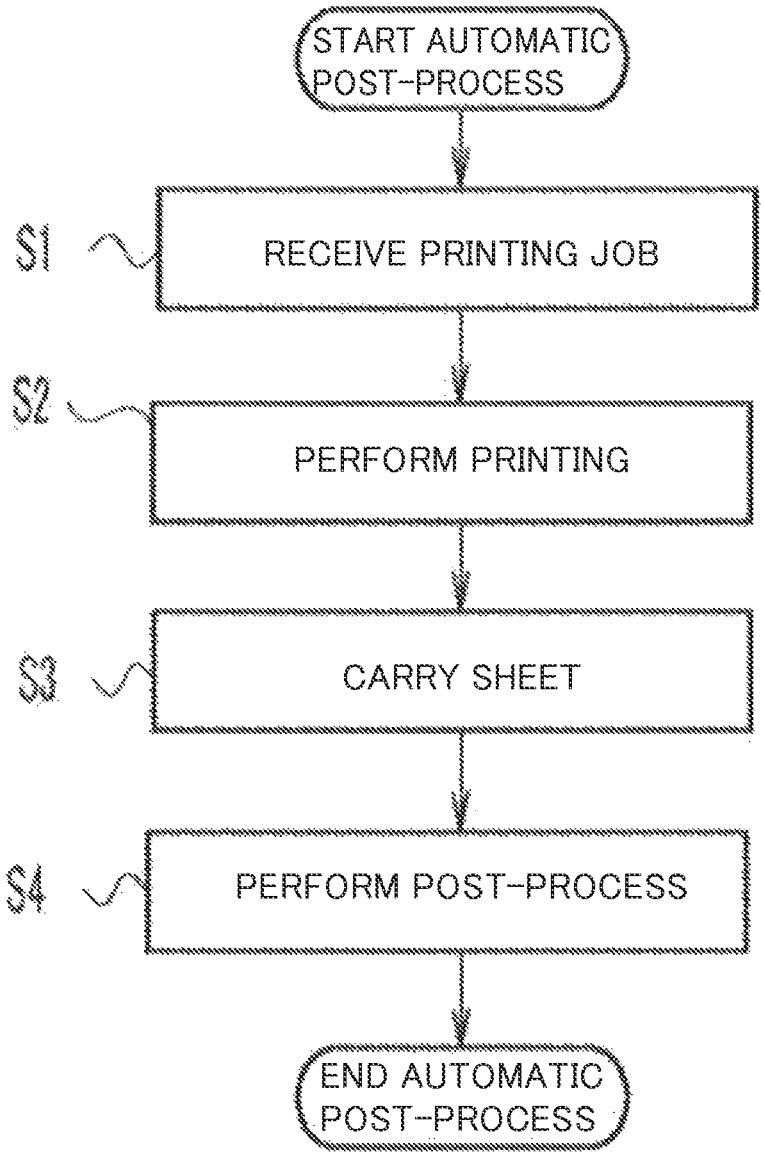
FIG. 3 is a flowchart illustrating an automatic post-process of the sheet post-processing system (first embodiment)

First, an automatic post-process will be described with reference to FIG. 3. FIG. 3 is a flowchart illustrating an automatic post-process of the sheet post-processing system 1 according to the embodiment.

In Step S1, the sheet post-processing system 1 first performs a process of "Receiving of print job" as an automatic post-process. More specifically, the printer 3 receives a print job of predetermined contents through the network controller 30 or the panel controller 29 by a user's manipulation with respect to the user terminal 23 or the manipulation panel unit 9.

The print job includes settings of the automatic post-process as well as printing conditions. The received print job is transmitted to the image forming unit 31. Next, the sheet post-processing system 1 allows the process in the automatic post-process to proceeds to Step S2.

Next, in Step S2, the sheet post-processing system 1 performs a process of "Performing of printing". More specifically, the image forming unit 31 of the printer 3 performs the print job to print and output an image on a sheet. After the printing, in the sheet post-processing system 1, the transport controller 33 controls the transporting unit 15 such that the sheet is transported to the finisher 5. Accordingly, the sheet post-processing system 1 allows the process to proceed to Step S3.

In Step S3, the sheet post-processing system 1 (finisher 5) performs a process of "Carrying of sheet". More specifically, the finisher 5 allows the sheet transported from the printer 3 to be carried into the carry-in portion 35 based on the control of the automatic post-process controller 53. Accordingly, the sheet post-processing system 1 (finisher 5) stocks the sheets as a sheet bundle B. Next, the sheet post-processing system 1 allows the process to proceed to Step S4.

In Step S4, the sheet post-processing system 1 (finisher 5) performs a process of "Performing of a post-process". More specifically, the automatic post-process controller 53 allows the post-processing unit 37 to perform a post-process on the sheet bundle B stocked according to the settings of the automatic post-process in the print job. Next, after the automatic post-process, the sheet post-processing system 1 (finisher 5) allows the sheet bundle to be ejected from the ejection outlet 39 of the finisher 5.

(Manual Post-Process)

Figure 4:
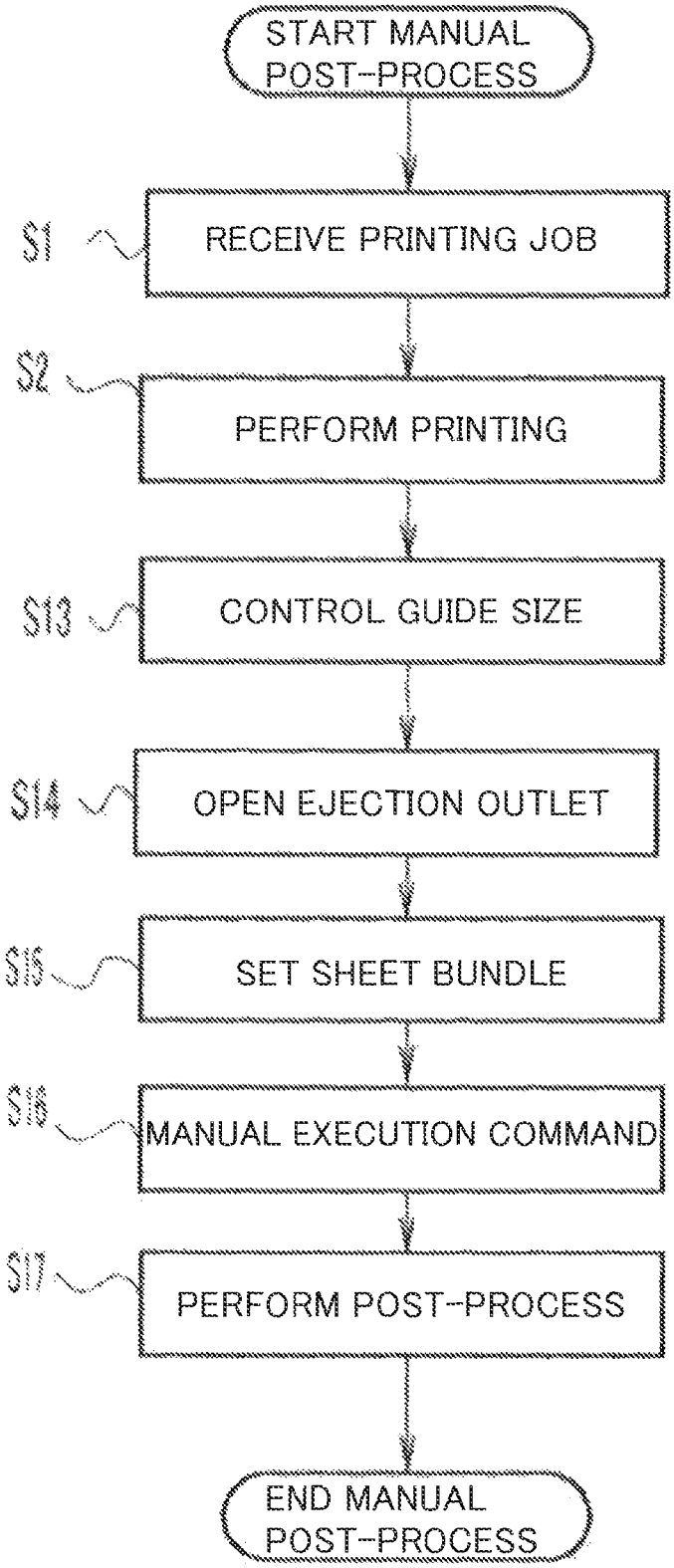
FIG. 4 is a flowchart illustrating a manual post-process of the sheet post-processing system (first embodiment)

FIG. 4 is a flowchart illustrating a manual post-process of the sheet post-processing system 1 according to the embodiment. In addition, in the embodiment, the case where the sheet post-processing system 1 allows a cover to be added to the sheet bundle B printed by the printer 3 and allows the finisher 5 to perform the manual post-process will be described.

In Step S1, similarly to the case of the automatic post-process, the sheet post-processing system 1 first performs a process of "Receiving of print job" as a manual post-process. Next, in Step S2, the sheet post-processing system 1 performs a process of "Performing of printing".

However, at the time of performing the manual post-process, the sheet post-processing system 1 does not perform the setting of the post-process of the print job, and when the printing-completed sheet is transported from the printer 3 to the finisher 5, the sheet post-processing system 1 ejects the sheet to the ejected sheet tray 42*b*. Accordingly, the sheet post-processing system 1 allows the process of the manual post-process to proceed to Step S13.

In Step S13, the sheet post-processing system 1 performs a process of "Controlling of guide size". In this process, the sheet post-processing system 1 matches the guide size of the guide portion 41 with the sheet size at the time of printing. The details of this process will be described separately with reference to FIG. 5. Accordingly, the sheet post-processing system 1 allows the process to proceed to Step S14.

In Step S14, the sheet post-processing system 1 performs a process of "Opening of ejection outlet". More specifically, the finisher 5 (manual process controller 57) receives an opening command through manipulation of the command input unit 43. Next, the manual process controller 57 controls an opening/closing driver such that the openable door 49 of the ejection outlet 39 is opened.

Accordingly, the sheet post-processing system 1 (finisher 5) becomes in a state where the ejection outlet 39 is opened and the sheet bundle B can be set. Next, the sheet post-processing system 1 allows the process to proceed to Step S15.

In Step S15, the sheet post-processing system 1 (finisher 5) performs a process of "Setting of sheet bundle". More specifically, the sheet post-processing system 1 adds a cover to the sheets which have been stocked to the ejected sheet tray 42*b* by a user, and then sets the sheets with the cover to the ejection outlet 39 of the finisher 5. Next, the sheet post-processing system 1 (finisher 5) allows the guide portion 41 to guide the set sheet bundle B to the processing position.

At this time, since the guide size is matched with the sheet size at the time of forming an image in the printer 3, the guide portion 41 can accurately guide the set sheet bundle B to the processing position. In this manner, the sheet post-processing system 1 completes the process of Step S15 and allows the process to proceed to Step S16.

In Step S16, the sheet post-processing system 1 (finisher 5) performs a process of "Manual execution command". More specifically, the manual process controller 57 receives a manual execution command through manipulation of the command input unit 43. Accordingly, the sheet post-processing system 1 allows the process to proceed to Step S17.

In Step S17, the sheet post-processing system 1 (finisher 5) performs a process of "Performing of post-process". More specifically, the manual process controller 57 allows the post-processing unit 37 to perform the post-process on the sheet bundle B at the processing position based on the manual execution command.

In this manner, since the manual post-process has a continuous relevance to the immediately-preceding printing process, the sheet post-processing system 1 is configured such that a predetermined post-process can be performed on the sheet bundle B including the sheets printed by the printer 3 by only the manual execution command.

In addition, the sheet post-processing system 1 according to the embodiment is configured such that the manual post-process having no relevance to the immediately-preceding printing process may be performed.

In the manual post-process, the sheet post-processing system 1 allows the user to perform the manual setting of the guide size through the manipulation panel unit 9 of the printer 3 and transmits the manually-set guide size information to the finisher 5. Next, the sheet post-processing system 1 changes the guide size of the guide portion 41 based on the manually-set guide size information. Next, the sheet post-processing system 1 performs the same processes as those of Steps S14 to S17 described above.

(Controlling of Guide Size)

Figure 5:
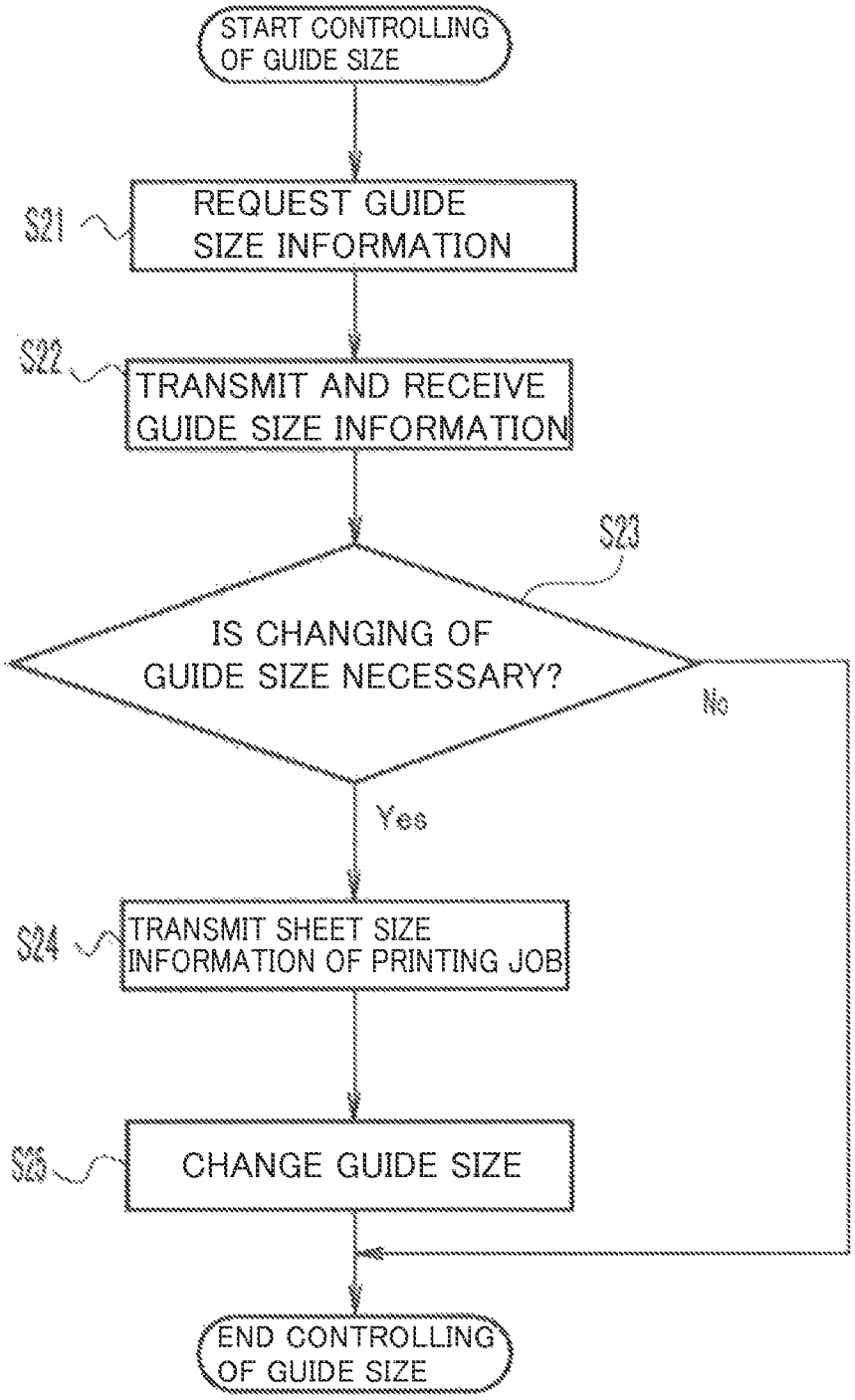
FIG. 5 is a flowchart illustrating controlling of a guide size of a guide portion (first embodiment)

FIG. 5 is a flowchart illustrating controlling of a guide size of the guide portion. In addition, since the controlling of the guide size is performed over the entire periods from the starting-up of the printer 3 and the finisher 5 to the manual post-process, Step S13 in FIG. 4 will be described as a portion thereof.

In the sheet post-processing system 1 (finisher 5), the controlling of the guide size starts with the starting-up of the printer 3 and the finisher 5 and includes the processes of Step 21 and the subsequent steps.

In Step S21, the sheet post-processing system 1 first performs a process of "Requesting for guide size information". More specifically, the finisher management unit 32 of the printer 3 requests for the transmission of the guide size information to the finisher 5. Accordingly, the sheet post-processing system 1 allows the process to proceed to Step S22.

In Step S22, the sheet post-processing system 1 performs a process of "Transmitting and receiving of guide size information". More specifically, the guide controller 55 of the finisher 5 transmits the guide size information of the guide portion 41 at this time to the printer 3.

Next, the finisher management unit 32 of the printer 3 receives the guide size information and stores the guide size information in the printer storage unit 19. Accordingly, the printer 3 can also manage the guide size information of the guide portion 41.

In this manner, in the sheet post-processing system 1, the process in Step S22 is completed, and the processes in Steps S23 to S25 corresponding to Step 13 in FIG. 4 are performed.

In Step S23, the sheet post-processing system 1 performs a process of "Is changing of guide size necessary?". The sheet post-processing system 1 performs a process of checking whether or not the changing of the guide size is necessary. More specifically, the finisher management unit 32 of the printer 3 acquires the guide size information from the printer storage unit 19 and compares the guide size information with the sheet size information of the print job.

Next, in the case where the guide size information is not matched with the sheet size information (in the case where the size specified by the guide size information is not matched with the size specified by the sheet size information), the sheet post-processing system 1 allows the process as "changing of guide size is necessary" to proceed to Step S24 (Yes). In addition, In the case where the guide size information is matched with the sheet size information (in the case where the size specified by the guide size information is matched with the size specified by the sheet size information), the sheet post-processing system 1 finishes controlling the guide size as "changing of guide size is unnecessary" (No). For example, in the case where the guide size corresponds to A4 and the sheet size corresponds to B5, the sheet post-processing system 1 allows the process to proceed to Step S24.

In Step S24, the sheet post-processing system 1 performs a process of "Transmitting of sheet size information of print job". More specifically, the finisher management unit 32 of the printer 3 transmits the sheet size information of the print job as setting of the guide size to the finisher 5. Accordingly, the sheet post-processing system 1 allows the process to proceed to Step S25.

In Step S25, the sheet post-processing system 1 (finisher 5) performs a process of "Changing of guide size". More specifically, the guide controller 55 of the finisher 5 receives the sheet size information from the printer 3 and controls the driving of the guide portion 41 according to the received sheet size information to change the guide size. For example, the sheet post-processing system 1 changes the guide size corresponding to the A4 sheet into the guide size corresponding to the B5 sheet.

Accordingly, the sheet post-processing system 1 can allow the guide size of the guide portion 41 to correspond to the sheet size at the time of printing. In this manner, the controlling of the guide size is completed, and the processes of the Step 14 and the subsequent steps in FIG. 14 are performed.

In addition, in the embodiment, although the sheet post-processing system 1 is configured such that controlling of the guide size is performed by the printer controller 21 of the printer 3 and the finisher controller 47 of the finisher 5, the sheet post-processing system 1 may be configured such that the controlling of the guide size is performed by only the finisher controller 47.

Effect of First Embodiment

In the embodiment, a sheet post-processing system 1 (finisher 5) includes the carry-in portion 35 which carries a sheet from the printer 3 capable of forming an image on a sheet, the guide portion 41 which guides a sheet bundle including the sheet carried from the carry-in portion 35 to a processing position, the command input unit 43 which accepts input of a manual execution command, the post-processing unit 37 which performs a predetermined post-process on the sheet bundle disposed at the processing position based on the manual execution command input through the command input unit 43, and the guide controller 55 which is connected to the printer 3 in a signal-receivable manner to receive sheet size information in an image formation period of the printer 3 and to control the driving of the guide portion 41 such that a guide size is changed based on the received sheet size information so as to match the guide size with sheet bundles having different sheet sizes.

Therefore, according to the embodiment, in the sheet post-processing system 1 (finisher 5), since the guide size of the guide portion 41 is changed according to the sheet size information at the time of printing, the guide size can be matched with the sheet size and a predetermined post-process can be performed by only the manual execution command in the manual post-process period immediately after the printing.

In this manner, according to the embodiment, in the sheet post-processing system 1 (finisher 5), the manual setting of the guide size in the manual post-process period may not be performed.

In addition, according to the embodiment, the sheet post-processing system 1 includes the manipulation panel unit 9 and the panel controller 29 of the printer 3 as a manual setting unit capable of performing the manual setting of the guide size for the sheet bundle B separately from the command input unit 43. Therefore, when the manual setting is performed through the manual setting unit, the sheet post-processing system 1 (finisher 5) is configured to allow the guide controller 55 to control to change the guide size of the guide portion based on the guide size information set through the manual setting.

Therefore, according to the embodiment, in the sheet post-processing system 1 (finisher 5), the manual post-process with the guide size changed through the manual setting can be performed similarly to the related art. Further, the post-process can also be accurately performed on the sheet bundle which has no relevance to the immediately preceding printing.

In addition, according to the embodiment, in the sheet post-processing system 1 (finisher 5), since the manual setting of the guide size is performed by using the manipulation panel unit 9 of the printer 3, the structure of the finisher 5 can be simplified, and cost reduction can be achieved.

Since the manual setting of the guide size may be omitted, the sheet post-processing system 1 (finisher 5) is configured such that the manual post-process can be easily performed by only the manual execution command in the finisher 5.

Second Embodiment

Figure 6:
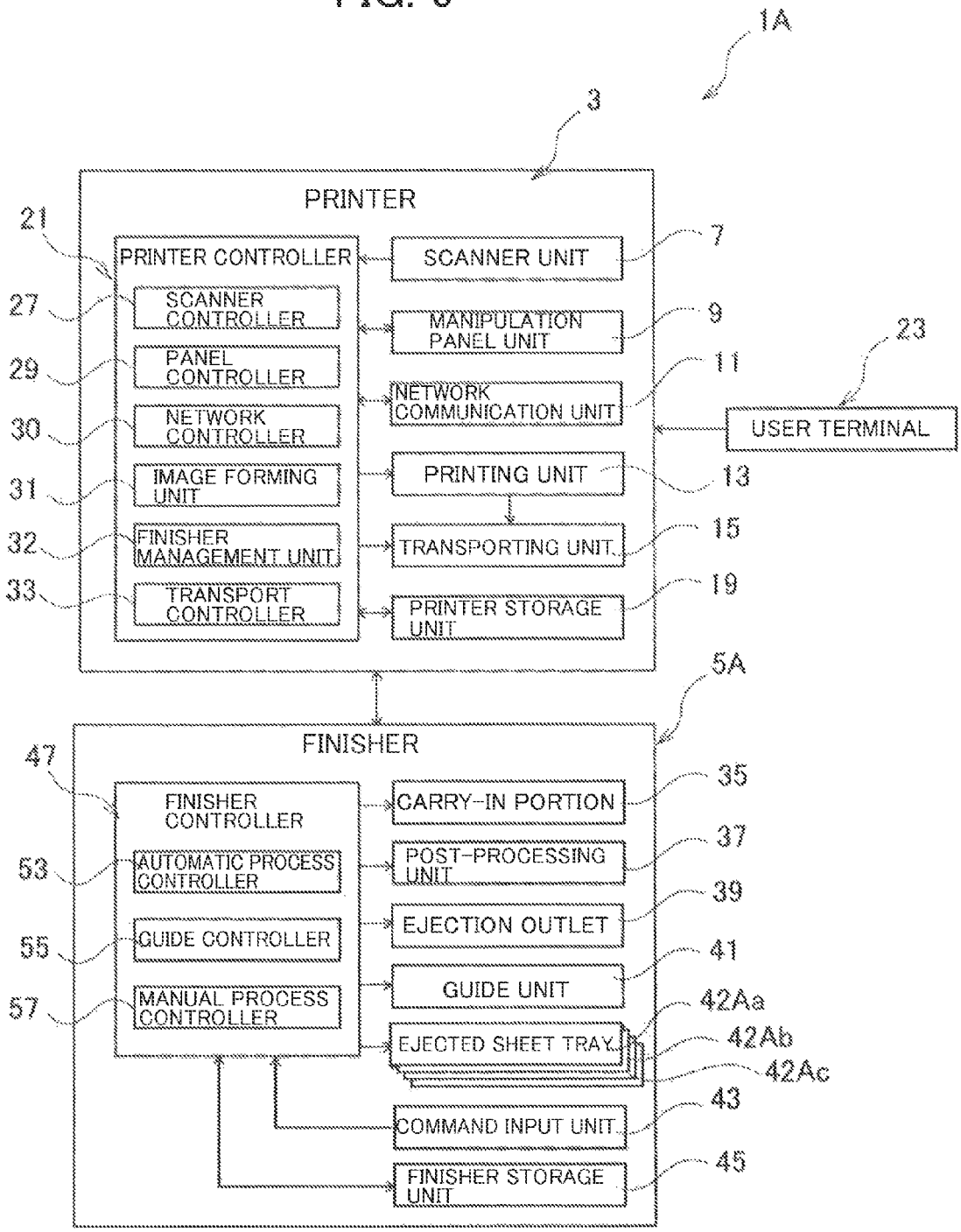
FIG. 6 is a block diagram illustrating a sheet post-processing system (second embodiment)

FIG. 6 is a block diagram illustrating a sheet post-processing system according to a second embodiment of the present disclosure. In addition, in the second embodiment, since the basic configuration of the sheet post-processing system 1A (finisher 5A) is the same as that of the first embodiment, the corresponding components are denoted by the same reference numerals or reference numerals added with A, and the redundant description thereof will not be repeated.

The sheet post-processing system 1A is configured to select whether or not the sheet size information at the time of printing is to be used for the controlling of the driving of the guide portion 41 at the time of setting a print job.

More specifically, as illustrated in FIG. 6, the finisher 5A is configured to include a plurality of ejected sheet trays 42Ab, 42Ac, . . . which eject and stock the printing-completed sheets. At the time of receiving the print job, the sheet post-processing system 1A allows the user to select which one of the ejected sheet trays 42Ab, 42Ac, . . . as an ejection site together with the setting of the printing conditions on the manipulation panel unit 9 of the printer 3 or the user terminal 23.

Next, in the case where a predetermined ejected sheet tray (one of the ejected sheet trays 42Ab, 42Ac, . . . ) is selected, the sheet post-processing system 1A is configured to allow the guide controller 55 of the finisher 5 to control the driving of the guide portion 41 based on the sheet size information at the time of printing (image formation period).

Therefore, in the embodiment, the manipulation panel unit 9 and the panel controller 29 of the printer 3 or the user terminal 23 and the network controller 30 of the printer 3 constitute a selection input unit for allowing selecting whether or not the controlling of the driving of the guide portion 41 together with the setting of the print job is to be performed.

Herein, instead of the selecting of the ejected sheet tray, the sheet post-processing system 1A (finisher 5A) may be configured to directly select and input whether or not the controlling of the driving of the guide portion 41 is to be performed.

In the embodiment, the sheet post-processing system 1A (finisher 5A) has the same function and effects as those of the first embodiment.

In addition, in the embodiment, only in the case where the controlling of the driving is selected by selecting a predetermined ejected sheet tray, the sheet post-processing system 1A (finisher 5A) can control the driving of the guide portion 41 based on the sheet size information at the time of printing.

As a result, according to the embodiment, the sheet post-processing system 1A (finisher 5A) can suppress the controlling of the unprepared guide portion 41, so that it is possible to suppress the post-process from being performed based on an erroneous guide size with respect to the manual post-process having no relevance to the immediately preceding printing process.

Third Embodiment

Figure 7:
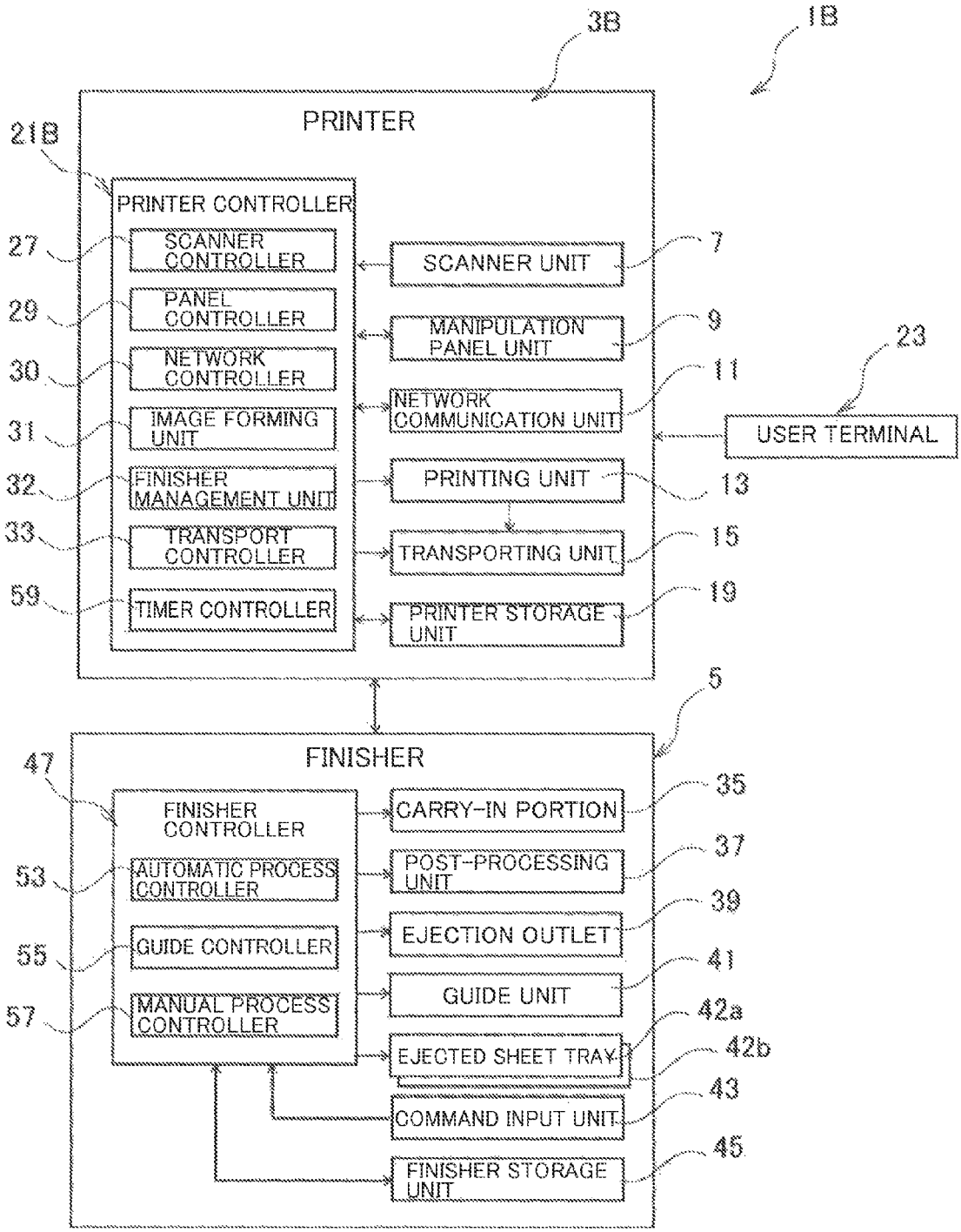
FIG. 7 is a block diagram illustrating a sheet post-processing system (third embodiment)

FIG. 7 is a block diagram illustrating a sheet post-processing system according to a third embodiment of the present disclosure. In addition, in the third embodiment, since the basic configuration of the sheet post-processing system 1B (finisher 5) is the same as that of the first embodiment, the corresponding components are denoted by the same reference numerals or reference numerals added with B, and the redundant description thereof will not be repeated.

Configuration and Operations of Sheet Post-Processing System

The sheet post-processing system 1B according to the embodiment is configured such that the guide size of the guide portion 41 is allowed to return to a default-setting size after a certain time elapses.

More specifically, as illustrated in FIG. 7, a printer controller 21B of a printer 3B includes a timer controller 59 as a timer unit.

The timer controller 59 counts the time elapsing after the changing of the guide size of the guide portion 41 and determines whether or not a certain time elapses. The counting of the elapsing time starts by using the transmission of the sheet size information or the guide size information by the finisher management unit 32 (the setting of the guide size) as a trigger.

In addition, when the guide size is adjusted again before a certain time elapses, the timer controller 59 determines whether or not a certain time elapses again from the time point.

Information indicating that a certain time elapses is transmitted from the timer controller 59 to the guide controller 55 of the finisher 5.

The guide controller 55 of the finisher 5 allows the guide portion 41 to return to the default guide size according to the time elapsing information. In the case where it is determined by the timer controller 59 that the certain time elapses (in the case where the information indicating that the certain time elapses is received), the guide controller 55 of the finisher 5 allows the guide portion to return to the default-setting size. The default guide size information is stored in the finisher storage unit 45.

Figure 8:
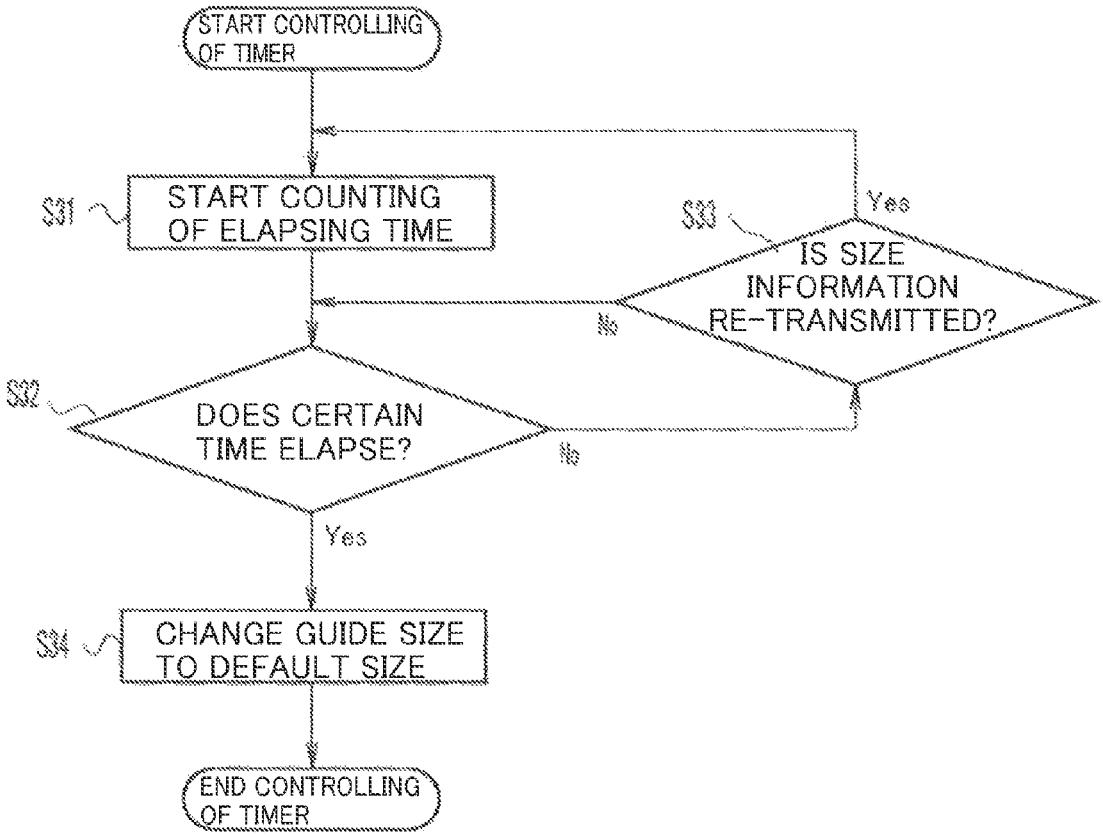
FIG. 8 is a flowchart illustrating controlling of a timer (third embodiment).

FIG. 8 is a flowchart illustrating controlling of a timer according to the third embodiment.

The controlling of the timer is performed in parallel to the controlling of the guide size in FIG. 5 of the first embodiment. When the process of Step 24 illustrated in FIG. 5 is performed, the process of controlling the guide size starts.

In Step S31, the sheet post-processing system 1B performs a process of "Starting of counting of elapsing time". More specifically, the timer controller 59 of the printer 3B starts counting of the time elapsing after the changing of the guide size by using the transmission of the sheet size information or the guide size information from the finisher management unit 32 as a trigger. Accordingly, the sheet post-processing system 1B allows the process to proceed to Step S32.

In Step S32, the sheet post-processing system 1B performs a process of "Does a certain time elapse?". The sheet post-processing system 1B performs a process of determining whether or not a certain time elapses. More specifically, the timer controller 59 determines whether or not the counted time reaches a certain time which is predetermined.

In the case where the counted time indicates that the certain time does not elapse (No), the sheet post-processing system 1B allows the process to proceed to Step S33. In addition, in the case where the counted time indicates that the certain time elapses (Yes), the sheet post-processing system 1B allows the process to proceed to Step S34.

In Step S33, the sheet post-processing system 1B performs a process of "Is size information re-transmitted?". The sheet post-processing system 1B determines whether or not the size information is re-transmitted. More specifically, the timer controller 59 determines whether or not the sheet size information or guide size information is re-transmitted from the finisher management unit 32. In the case where the information is determined to be re-transmitted (Yes), the sheet post-processing system 1B allows the process to return to Step S31. In addition, in the case where the information is determined not to be re-transmitted (No), the sheet post-processing system 1B allows the process to return to Step S32.

In Step S34, the sheet post-processing system 1B performs a process of "Changing of guide size to default size". More specifically, the timer controller 59 transmits information indicating that the certain time elapses to the guide controller 55 of the finisher 5. When the guide controller 55 of the finisher 5 receives the information indicating that the certain time elapses, the guide controller 55 controls the guide portion 41 to allow the guide size to return to the default-setting size.

For example, in the sheet post-processing system 1B, in the case where the immediately preceding guide size corresponds to B5 size and the default guide size corresponds to A4 size, the guide size is allowed to return to the A4 size.

In addition, although the controlling of the timer according to the embodiment is performed as a process of the printer controller 21B of the printer 3B, the controlling may be performed as a process of the finisher controller 47 of the finisher 5. More specifically, the timer controller may be disposed to the finisher 5 rather than the printer 3B.

In the third embodiment, the sheet post-processing system 1B (finisher 5) can have the same functions and effects as those of the first embodiment.

In addition, in the embodiment, in the sheet post-processing system 1B (finisher 5), when a certain time elapses after the changing of the guide size of the guide portion 41, the guide size is allowed to return to the default-setting size. Therefore, it is possible to suppress the post-process based on an erroneous guide size from being performed in the manual post-process having no relevance to the immediately preceding printing process.

Similarly, although the sheet post-processing system 1B (finisher 5) performs the manual setting of the guide size at the time of the immediately preceding manual post-process, it is possible to suppress the post-process based on an erroneous guide size from being performed in the manual post-process having no relevance thereto.

The invention claimed is:

1. A sheet post-processing apparatus comprising:

a carry-in portion that carries a sheet from an image forming apparatus capable of forming an image on the sheet;

a guide portion that guides a sheet bundle including the sheet carried from the carry-in portion to a processing position;

a command input unit that accepts input of a manual execution command;

a post-processing unit that performs a predetermined post-process on the sheet bundle disposed at the processing position based on the manual execution command entered through the command input unit;

a guide controller that is connected to the image forming apparatus in a signal-receivable manner to receive sheet size information in an image formation period of the image forming apparatus and to control driving of the guide portion to change a guide size based on the received sheet size information so as to match the guide size with sheet bundles having different sheet sizes; and a plurality of ejected sheet trays for sheet ejection, wherein, in the case where the image forming apparatus includes a selection input unit for allowing selecting whether or not controlling of driving of the guide portion is to be performed together with setting for an image formation, when selection is made through the selection input unit to perform the controlling of driving, the guide controller controls the driving of the guide portion based on the sheet size information in the image formation period, wherein the selection input unit is configured such that any one of the ejected sheet trays for sheet ejection can be selected, wherein selecting of the controlling of the driving is selecting of an ejected sheet tray for sheet ejection performed through the selection input unit, and wherein, in the case where a predetermined ejected sheet tray is selected through the selection input unit, the guide controller controls the driving of the guide portion based on the sheet size information of the image formation period.

2. The sheet post-processing apparatus according to claim 1, wherein, in the case where the image forming apparatus includes a manual setting unit capable of performing manual setting of the guide size separately from the command input unit, when the manual setting is performed through the manual setting unit, the guide controller changes the guide size of the guide portion based on guide size information set through the manual setting.

3. The sheet post-processing apparatus according to claim 2, wherein the manual setting unit is a manipulation input portion of the image forming apparatus.

4. The sheet post-processing apparatus according to claim 1, wherein, in the case where the image forming apparatus includes a timer unit which counts an amount of time elapsing after changing of the guide size of the guide portion and determines whether or not a certain amount of time elapses, when the timer unit determines that the certain amount of time elapses, the guide controller allows the guide size to return to a default-setting size.

5. The sheet post-processing apparatus according to claim 1, further comprising:

a timer unit that counts an amount of time elapsing after changing of the guide size of the guide portion and determines whether or not a certain amount of time elapses, wherein, in the case where the timer unit determines that the certain amount of time elapses, the guide controller allows the guide size to return to a default-setting size.

6. A sheet post-processing system comprising:

an image forming apparatus capable of forming an image on a sheet; and a sheet post-processing apparatus, wherein the sheet post-processing apparatus includes a carry-in portion that carries a sheet from the image forming apparatus, a guide portion that guides a sheet bundle including the sheet carried from the carry-in portion to a processing position, a command input unit that accepts input of a manual execution command, a post-processing unit that performs a predetermined post-process on the sheet bundle disposed at the processing position based on the manual execution command entered through the command input unit, a guide controller that is connected to the image forming apparatus in a signal-receivable manner to receive sheet size information in an image formation period of the image forming apparatus and to control driving of the guide portion to change a guide size based on the received sheet size information so as to match the guide size with sheet bundles having different sheet sizes, and a plurality of ejected sheet trays for sheet ejection, wherein the image forming apparatus includes a selection input unit for allowing selecting whether or not controlling of driving of the guide portion is to be performed together with setting for an image formation, and wherein, when selection is made through the selection input unit to perform the controlling of driving, the guide controller controls the driving of the guide portion based on the sheet size information in the image formation period, wherein the selection input unit is configured such that any one of the ejected sheet trays for sheet ejection can be selected, wherein selecting of the controlling of the driving is selecting of an ejected sheet tray for sheet ejection performed through the selection input unit, and wherein, in the case where a predetermined ejected sheet tray is selected through the selection input unit, the guide controller controls the driving of the guide portion based on the sheet size information of the image formation period.

7. The sheet post-processing system according to claim 6, wherein the image forming apparatus includes a manual setting unit capable of performing manual setting of the guide size separately from the command input unit, and wherein, when the manual setting is performed through the manual setting unit, the guide controller changes the guide size of the guide portion based on guide size information set through the manual setting.

8. The sheet post-processing system according to claim 7, wherein the manual setting unit is a manipulation input portion of the image forming apparatus.

9. The sheet post-processing system according to claim 6, wherein the image forming apparatus or the sheet post-processing apparatus includes a timer unit that counts an amount of time elapsing after changing of the guide size of the guide portion and determines whether or not a certain amount of time elapses, and wherein, in the case where the timer unit determines that the certain amount of time elapses, the guide controller allows the guide size to return to a default-setting size.

* * * * *